United States Patent [19]

Garthus

[11] Patent Number: 4,591,275

[45] Date of Patent: May 27, 1986

[54] APPARATUS FOR MIXING PULVERULENT MATERIAL ON A CONVEYOR BELT

[75] Inventor: Donald R. Garthus, Crete, Ill.

[73] Assignee: Interlake, Inc., Oak Brook, Ill.

[21] Appl. No.: 620,907

[22] Filed: Jun. 15, 1984

[51] Int. Cl.[4] ..... B01F 13/00

[52] U.S. Cl. ..... 366/349

[58] Field of Search ..... 366/1, 349, 109, 150, 366/154, 186, 345, 346; 209/308; 198/636; 241/200

[56] References Cited

U.S. PATENT DOCUMENTS 2,590,051 3/1952 Spain ..... 198/636 X
3,904,723 9/1975 Prince ..... 366/109 X

FOREIGN PATENT DOCUMENTS 41297 12/1929 Denmark ..... 366/181
2409269 8/1975 Fed. Rep. of Germany ..... 366/349
3035035 4/1981 Fed. Rep. of Germany ..... 366/1
604706 7/1948 United Kingdom ..... 366/346

*Primary Examiner*—Philip R. Coe
*Attorney, Agent, or Firm*—Emrich & Dithmar

[57] ABSTRACT

Pulverulent or other bulk material is conveyed in a continuous stream on a belt conveyor, the stream comprising a plurality of substreams of different compositions which are deposited by hoppers onto the conveyor belt. A frame straddles the conveyor belt downstream from the hoppers and carries a plurality of fixed plow assemblies which depend from the frame at locations spaced apart laterally and longitudinally of the conveyor belt, each plow assembly having a plow blade which extends into the stream of pulverulent material. The blades are variously oriented, each blade displacing the engaged portion of the stream both vertically and laterally of the conveyor belt to mix together the compositions of the substreams.

18 Claims, 8 Drawing Figures

APPARATUS FOR MIXING PULVERULENT MATERIAL ON A CONVEYOR BELT

The present invention relates to the mixing of bulk materials which can be conveyed in a continuous stream by a conveyor belt. The invention has particular application to the mixing of a stream of coal, but may be applied to any type of pulverulent, crushed or other bulk material.

In the manufacture of coke, the feedstock for the coke oven typically comprises pulverized coals, which are fed to the coke oven in a continuous stream, as on a conveyor belt. Preferably, the stream of coal comprises several different types of coals producing a blend designed to achieve optimum performance. These different types of coals are fed onto the conveyor belt in substreams which cooperate to make up the main stream of material on the conveyor belt.

Ideally, these substreams of different types of coal should be thoroughly mixed to form a substantially homogeneous stream before introduction into the coke oven, but any degree of mixing of the substreams is beneficial and is better than none at all. Equipment for effecting thorough mixing of a plurality of different types of coals is available, but it is quite expensive. Furthermore, mixing with such a mixing device would have to be effected before the coals are applied to the conveyor belt leading to the coke oven, necessitating the addition of a major piece of equipment. This may create a serious difficulty in the case of a retrofit to an existing installation.

SUMMARY OF THE INVENTION

It is a general object of the present invention to provide an improved mixing apparatus for pulverulent or other bulk material conveyed by a belt conveyor which avoids the disadvantages of prior mixing devices while affording additional structural and operating advantages.

An important object of the invention is the provision of mixing apparatus which is capable of mixing the conveyed material as it is being conveyed on a conveyor belt.

In connection with the foregoing object, it is another object of this invention to provide a mixing apparatus of the type set forth, which is adjustable for effecting different degrees and types of mixing.

Still another object of the invention is the provision of mixing apparatus of the type set forth which is of simple and economical construction.

Yet another object of the invention is the provision of mixing apparatus which can easily be applied to an existing conveyor system without necessitating movement, modification or disconnection of the conveying apparatus.

Another object of the invention is the provision of a conveyor system which incorporates mixing apparatus of the type set forth.

These and other objects of the invention are attained by providing mixing apparatus for mixing pulverulent or other bulk material while it is conveyed in a continuous stream on a belt conveyor, wherein the stream is made up of a plurality of substreams of different compositions, the mixing apparatus comprising: plow means supported adjacent to and extending into the stream of material on the conveyor belt, the plow means including a plurality of fixed spaced-apart blades each arranged to engage a portion of the stream and displace that portion relative to the conveyor belt for commingling adjacent substreams, thereby to mix together the compositions of the substreams.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
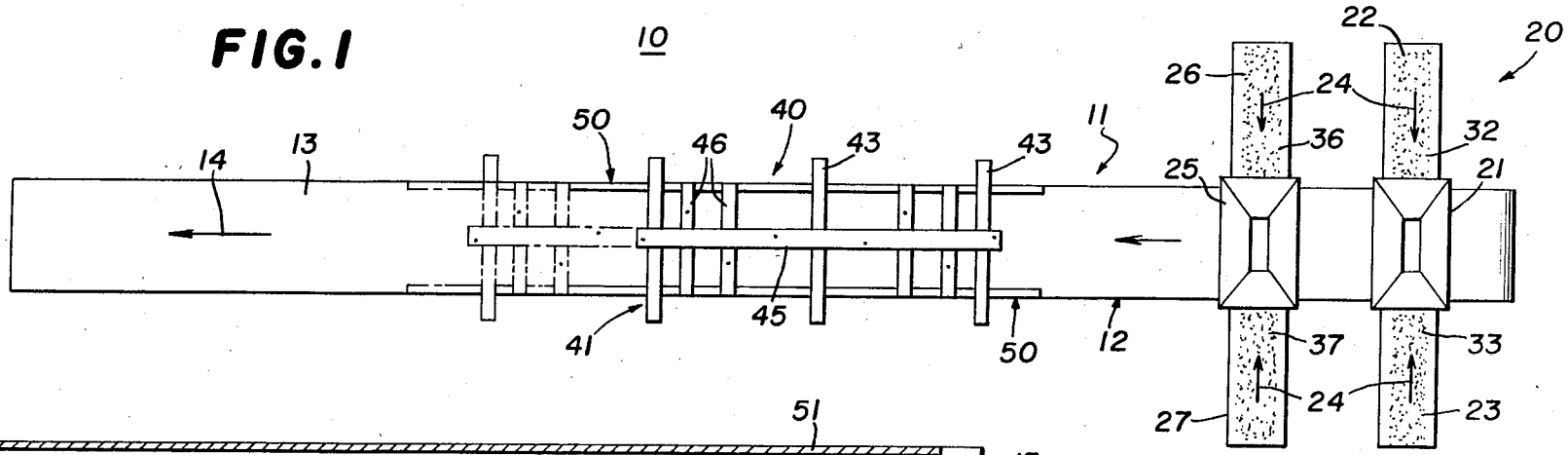
FIG. 1 is a top plan view of a conveyor system incorporating mixing apparatus constructed in accordance with and embodying the features of the present invention.
Figure 2:
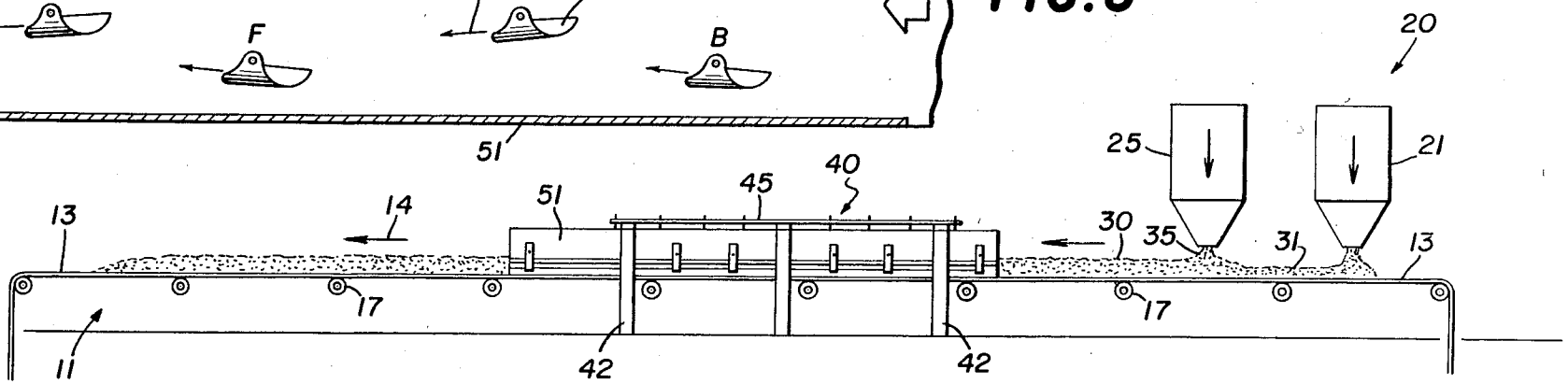
FIG. 2 is a side elevational view of the conveyor system of FIG. 1.

Referring to FIGS. 1 and 2 of the drawings, there is illustrated a conveyor system, generally designated by the numeral 10, for conveying bulk material, such as crushed or pulverulent material. While the conveyor system 10 could be utilized with any types of bulk material, the invention has particular application to the feeding of pulverized coal to a coke oven, and will be described with respect to that application.

The conveyor system 10 includes a conveyor 11 which may be a belt conveyor including an endless belt 12 having a support reach 13 movable in the direction indicated by the arrows 14, the return reach and drive means not being shown in the drawing. The support reach 13 is slightly concave in transverse cross section, being supported on a support assembly 15. More specifically, and referring also to FIGS. 3–5 of the drawings, the support assembly 15 includes a plurality of pairs of upstanding inner supports 16, the pairs being spaced apart longitudinally of the conveyor 11 and the supports of each pair being spaced apart transversely of the conveyor 11. Respectively rotatably supported by the pairs of inner supports 16 are a plurality of horizontally disposed center rollers 17. Respectively disposed outboard of the inner supports 16 are a like plurality of upstanding outer supports 18, each outer support 18 cooperating with the associated inner support 16 for rotatably supporting therebetween an associated one of a plurality of inclined side rollers 19. Thus, it will be appreciated that each center roller 17 cooperates with its associated side rollers 19 for supporting the support reach 13 of the conveyor belt 12 in its concave configuration in a well known manner.

The conveyor system 10 includes a loading system 20 for loading conveyed material onto the conveyor belt 12 (see FIGS. 1 and 2). The loading system 20 includes a first hopper 21 overlying the leading end of the support reach 13 and into which are fed two input conveyors 22 and 23, which may also be belt conveyors, and which respectively convey product to the hopper 21 in the directions indicated by the arrows 24. Downstream from the hopper 21 there is disposed a second hopper 25 which also overlies the support reach 13, and into which are fed input conveyors 26 and 27, which respectively convey product to the hopper 25 in the directions indicated by the arrows 24.

In order to obtain optimum performance in the manufacture of coke, it is typically desirable to feed to the coke oven a blend of a number of different types of coals, including both soft coals and hard coals. These different coals are all loaded onto the conveyor belt 12 to form a composite main stream 30 which is conveyed to the associated coke oven. More specifically, the first hopper 21 deposits a lower layer 31 of coals on the support reach 13 of the conveyor belt 12. This lower layer 31 may, for example, be a blend of high volatile coals and petroleum coke which are fed, respectively, in substreams 32 and 33 to the hopper 21 by the input conveyors 22 and 23. The second hopper 25, located downstream from the hopper 21, will deposit on top of the lower layer 31 an upper layer 35 of coals. The upper layer 35 may comprise, for example, high volatile fluid coals and low volatile coals, which are respectively fed in substreams 36 and 37 to the hopper 25 by the input conveyors 26 and 27.

Some mixing of the substreams 32 and 33 may be effected in the hopper 21, depending upon the feed rates of the input conveyors 22 and 23 and, similarly, some mixing of the substreams 36 and 37 may be effected in the hopper 25, depending upon the feed rates of the input conveyors 26 and 27. But the range of freedom in adjusting the feed rates of the input conveyors 22, 23, 26 and 27 is limited, since these feed rates must be compatible with the number of loading hoppers used, the carrying capacity of the conveyor belt 12 and the desired feed rate for the associated coke oven. Accordingly, the mixing achieved by the loading hoppers 21 and 25 may be minimal and, in certain applications, the substreams 32 and 33 may be substantially deposited side-by-side on the conveyor belt 12, as may the substreams 36 and 37. In any event, the loading system 20 achieves negligible mixing of the lower and upper layers 31 and 35 of conveyed coals.

Accordingly, mixing apparatus 40, constructed in accordance with and embodying the features of the present invention, is disposed along the conveyor 11 downstream from the hopper 25. The mixing apparatus 40 has a frame 41, including a plurality of pairs of upstanding posts 42 spaced apart longitudinally of the conveyor 11, the posts 42 of each pair being respectively disposed along opposite sides of the conveyor 11 outboard of the supporting structure therefor. The posts 42 extend upwardly well above the support reach 13 of the conveyor belt 12, the posts 42 of each pair being interconnected at their upper ends by one of a like plurality of cross beams 43 which overlie the conveyor belt 12. Preferably, each of the posts 42 and cross beams 43 is in the form of a channel member, the cross beams 43 being fixedly secured to the posts 42 by suitable means, such as welding, although other forms of attachment could be used.

The cross beams 43 are all interconnected by an elongated center support member 45 which extends longitudinally of the conveyor 11 substantially centrally of the support reach 13. The center support member 45 may be a flat bar or plate, and may be fixedly secured to the cross beams 43, as by welding, threaded fasteners or any other suitable means. Fixedly secured to the center support member 45 at longitudinally spaced apart locations thereon are a plurality of transverse support members 46, each extending laterally outwardly substantially to the outer edges of the support reach 13. Preferably, the transverse support members 46 are channel members, and are fixedly secured to the center support member 45 by welding, threaded fasteners or other suitable means.

Figure 3:
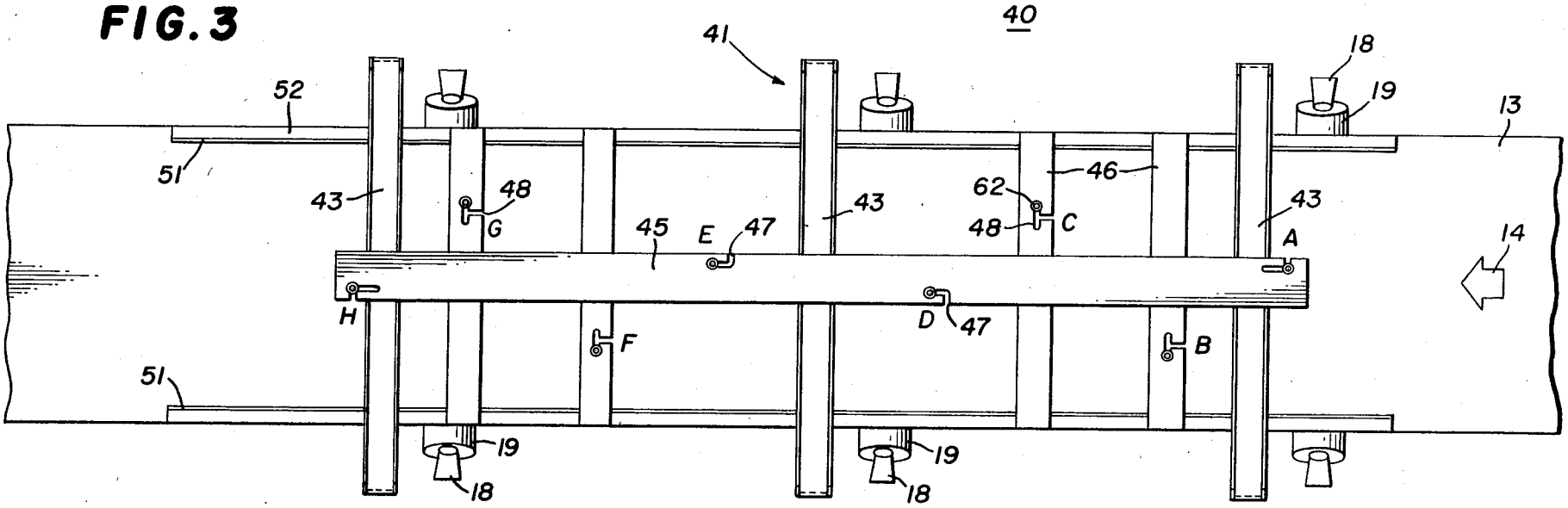
FIG. 3 is an enlarged, fragmentary, top plan view of the mixing apparatus of FIG. 1.
Figure 4:
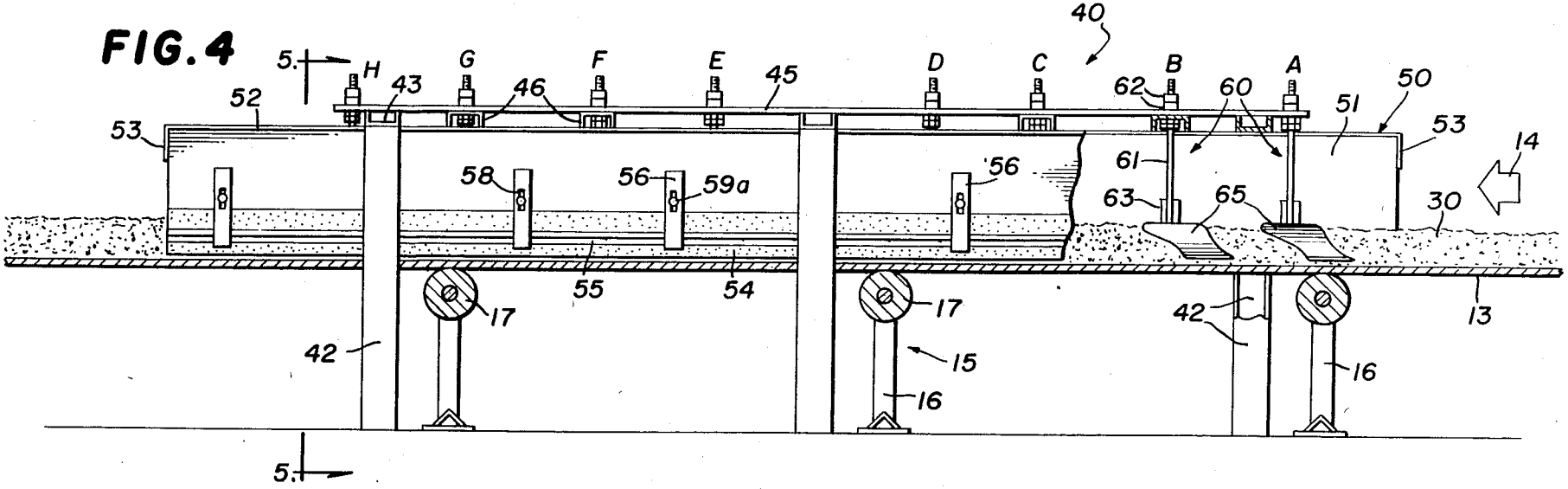
FIG. 4 is a fragmentary side elevational view in partial vertical section of the mixing apparatus of FIG. 3.

The center support member 45 is provided along each of the opposite side edges thereof with a plurality of longitudinally spaced-apart, generally L-shaped slots 47, and each of the of the transverse support members 46 is provided along its leading edge with at least one generally T-shaped slot 48 (see FIG. 3).

Mounted on the frame 41 are two retaining assemblies 50, respectively disposed adjacent to opposite side edges of the support reach 13. Preferably, the retaining assemblies 50 are constructed substantially as mirror images of each other, so that only one will be described in detail. Each retaining assembly 50 includes a rectangular side plate 51 which is disposed vertically in use and is elongated so as to extend along a substantial length of the support reach 13 adjacent to one side edge thereof. Fixedly secured to the side plate 51 at the upper edge thereof, as by welding, and projecting laterally outwardly therefrom is an attachment bar 52, provided at the opposite ends thereof, respectively, with depending end flanges 53 which extend downwardly along the adjacent end edges of the side plate 51 (see FIG. 4). The attachment bar 52 is fixedly secured, as by welding, threaded fasteners or the like, to the cross beams 43 and the transverse support members 46 of the frame 41 so as to be suspended therefrom.

The side plate 51 has a width such that, when mounted in place, the lower edge thereof is spaced a predetermined distance above the support reach 13 of the conveyor belt 12. Disposed along the outer surface of the side plate 51 at the lower end thereof is an elongated bearing member 54, which extends the length of the side plate 51 and is formed of a resilient material such as rubber. Fixedly secured to the bearing member 54 and extending the length thereof is a mounting bar 55, which may be in the form of an angle member. Fixedly secured to the mounting bar 55, as by welding, and extending vertically therefrom are a plurality of longitudinally spaced-apart adjustment bars 56, each provided at its upper end with a laterally inturned flange 57 (see FIG. 5), having a length such as to bear against the outer surface of the side plate 51 when the adjustment bar 56 is disposed parallel to the side plate 51. Each of the adjustment bars 56 has a vertical elongated slot 58 therein (see FIG. 4), through which is received a horizontal threaded stud 59 which is secured, as by welding, to the the outer surface of the side plate 51 and projects laterally outwardly therefrom. Nuts 59*a* are respectively threadedly engaged with the studs 59 securely to hold the adjustment bars 56 and the bearing members 54 securely in place against the side plate 51.

In use, the bearing members 54 are vertically adjusted so that the lower edges thereof just touch the upper surface of the support reach 13, to close the gap between the support reach 13 and the lower ends of the side plates 51. In this way, the retaining assemblies 50 cooperate laterally to confine the conveyed material on the support reach 13 as it is conveyed through the mixing apparatus 40. As the lower edges of the bearing members 54 wear with use, the nuts 59*a* can be loosened and the adjustment bars 56 tapped downwardly to maintain contact between the support reach 13 and the lower edges of the bearing members 54.

It is a significant aspect of the present invention that the frame 41 can be preassembled with or without the retaining assemblies 50 and deposited, as a unit, over the conveyor 11 or, alternatively, could be erected on-site at the conveyor 11. But, in either event, the frame 41 can be installed in place without any disturbance or modification of the conveyor 11.

Figure 6:
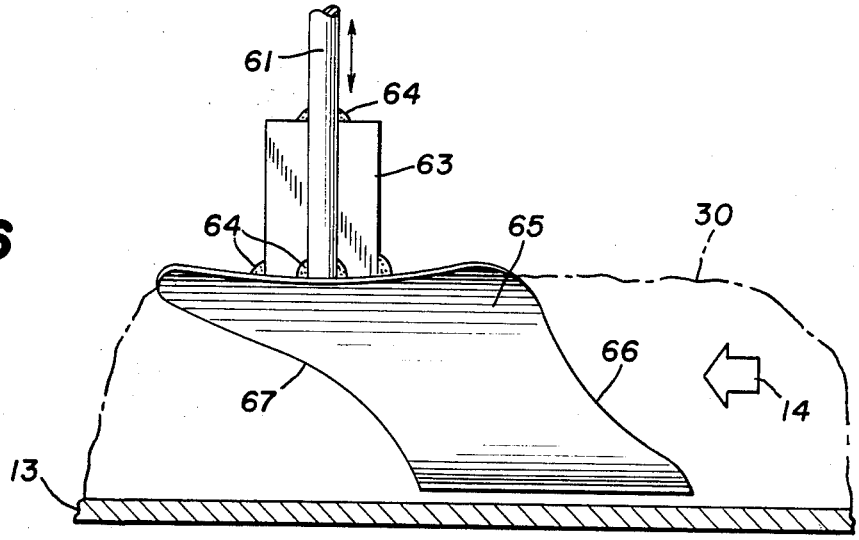
FIG. 6 is a still further enlarged, fragmentary, sectional view taken along the line 6—6 in FIG. 5, and illustrating one of the plow blades of the present invention.
Figure 7:
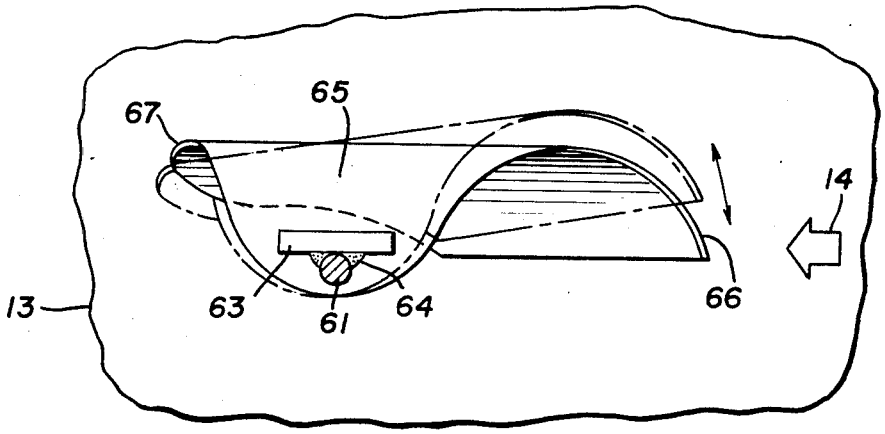
FIG. 7 is a top plan view of the plow blade of FIG. 6, illustrating pivotal movement thereof.

The mixing apparatus 40 also includes a plurality of plow assemblies, each generally designated by the numeral 60. Referring also to FIGS. 6 and 7 of the drawings, each of the plow assemblies 60 includes an elongated vertical mounting rod 61, threaded at its upper end for threaded engagement with a plurality of lock nuts 62, securely to mount the mounting rod 61 in place on the frame 41, as will be explained below. Fixedly secured to the lower end of each mounting rod 61 is a rectangular gusset plate 63, the mounting rod 61 and the gusset plate 63 being connected, as by weldments 64, to each other and to the top of a plow blade 65. The plow blade 65 may have any desired configuration, depending upon the particular application and the particular type of material being conveyed. However, in the preferred embodiment, each of the plow blades 65 is substantially identical in construction, each being cut from a circularly tubular member, so that the plow blade 65 is part-cylindrical in transverse cross section, being provided with fluted leading and trailing edges 66 and 67, each of which slopes downwardly and forwardly toward the working or leading end of the plow blade 65, as is best seen in FIGS. 6 and 7.

Figure 8:
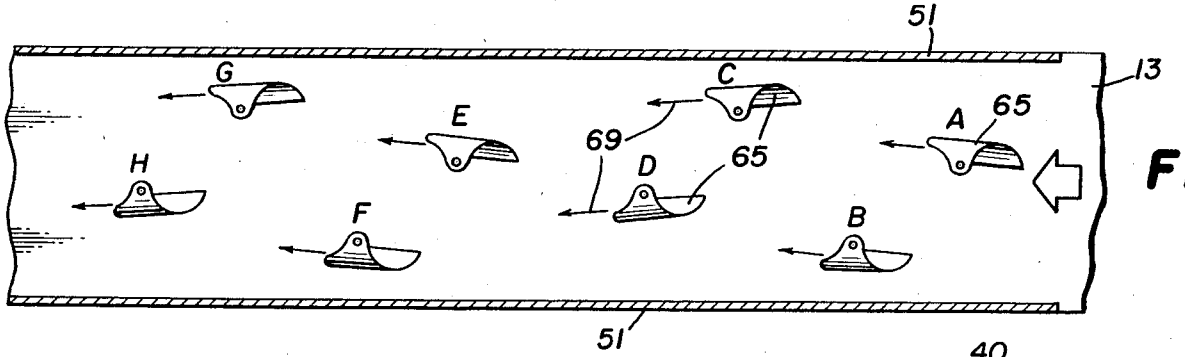
FIG. 8 is an enlarged fragmentary view in horizontal section of the mixing apparatus of FIG. 2, illustrating the arrangement of the plow blades.
Figure 5:
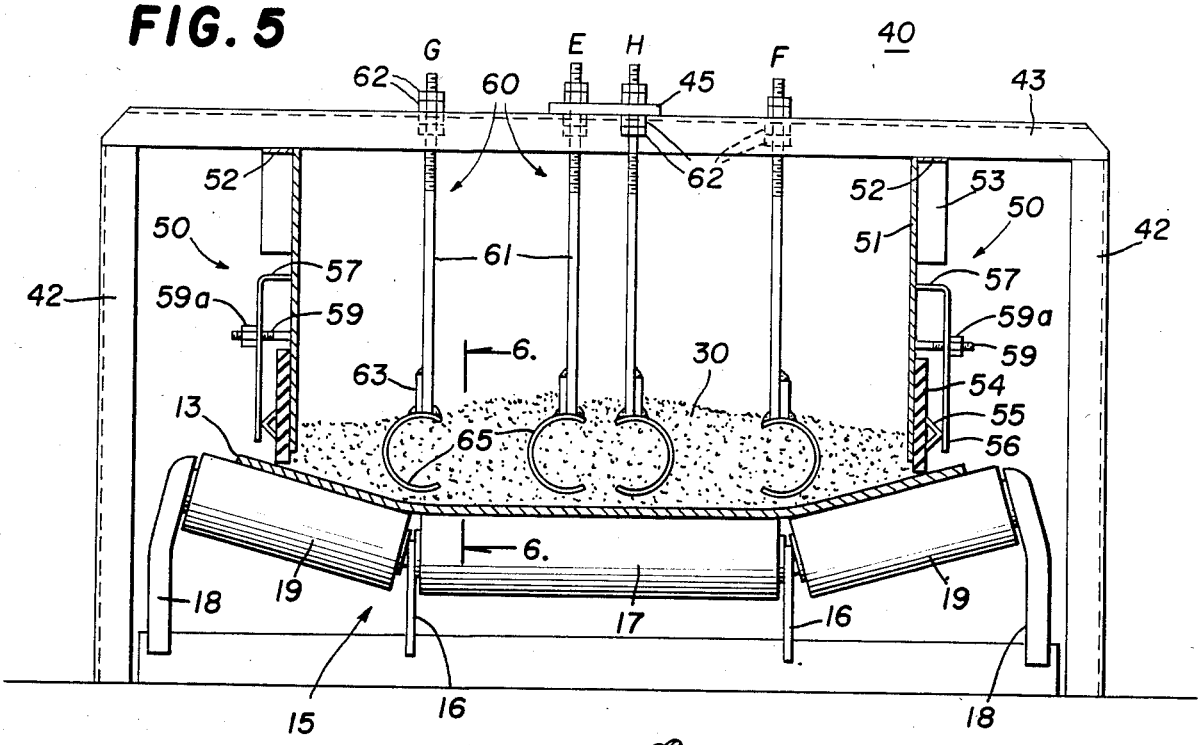
FIG. 5 is a further enlarged view in vertical section taken along the line 5—5 in FIG. 4.

Any desired number of the plow assemblies 60 may be provided, and they may be mounted in any desired type of array, depending upon the requirements of the particular application. In the illustrated embodiment, eight of the plow assemblies 60 are shown, respectively designated A through H, and arranged as indicated in FIGS. 3, 5 and 8. Thus, it can be seen that the plow assemblies 60 are arranged in two center rows of two plows each, the center rows being respectively disposed along opposite side edges of the center support member 45, and two side rows of two plows each, the two side rows being respectively carried by the transverse support members 46. More specifically, each of the mounting rods 61 is disposed in a corresponding one of the slots 47 or 48 and is fixedly secured thereto by the lock nuts 62.

It will be appreciated that by threaded adjustment of the lock nuts 62, the vertical positioning of each of the plow blades 65 may be adjusted. Preferably, each of the plow assemblies 60 is adjusted so that the associated plow blade 65 is disposed with the lower edge thereof spaced a slight distance from the upper surface of the support reach 13, so as to provide for maximum depth of insertion in the main stream 30 of conveyed material, but without contacting the support reach 13. However, it will be appreciated that the depth of insertion of the plow blade 65 may be varied for different types of applications.

It will be appreciated that slight longitudinal adjustment of the positions of the plow assemblies 60 in the center rows thereof is permitted by the longitudinal extent of the L-shaped slots 47. Similarly, slight longitudinal and lateral adjustment of the positions of the plow assemblies 60 in the side rows thereof is permitted by the shape of the T-shaped slots 48. It will, of course, readily be appreciated that any number of the slots 47 and 48 could be provided to afford maximum flexibility in positioning of the plow assemblies 60 and, for the same purpose, any desired number and positioning of the transverse support members 46 could be provided.

Referring to FIG. 7, it can also be seen that by rotation of the mounting rods 61 about their longitudinal axes, the plow blades 65 can be tilted to change the angle of attack thereof. In this way, the lateral direction in which the conveyed material is thrown by the plow blade 65 can be altered.

While, for convenience of illustration, the mixing apparatus 40 has been shown with eight of the plow assemblies 60, it will be appreciated that any desired number could be provided. In one preferred embodiment of the invention, it has been found desirable to use twelve such plow assemblies 60. For this purpose, the mixing apparatus 40 can readily be extended, as indicated in broken lines in FIG. 1, to the twelve-plow version of the invention.

In operation, the main stream 30 of coals or other conveyed material is fed in the direction of the arrows 14 through the mixing apparatus 40. The plow assemblies 60 are fixed in position with respect to the moving main stream 30 and are disposed so that the plow blades 65 are embedded in and engage the conveyed material. The plow blades 65 operate to throw the engaged portions of the main stream 30 upwardly or transversely of the support reach 13 and laterally inwardly or outwardly, depending upon the attack angle of the plow blades 65. One arrangement of the plow blades 65 is illustrated in FIG. 8, the lateral throw of the engaged portions of the main stream 30 being generally in the directions indicated by the arrows 69. In general, the conveyed material is thrown laterally outwardly toward the side plates 51 and then back inwardly toward the center of the support reach 13. However, it will be appreciated that any other throw pattern could be utilized. Thus, there is achieved a lateral mixing of the coals in the substreams 32, 33, 36 and 37, as well as a vertical mixing of the coals in the lower and upper layers 31 and 35. The extent of mixing will depend upon the number of plow assemblies 60 utilized, the speed of the conveyor 11, the angle of attack of the plow blades 65, the depth of insertion in the main stream 30 and other factors.

The mixing apparatus 40 is not intended to obtain 100% mixing of the main stream 30 into a completely homogeneous mixture. But it will achieve substantial mixing and significantly improved operation of the associated coke oven at a cost which is only a small fraction of the cost of a standard mixing device, and which entails no modification of the conveyor 11.

While, in the preferred embodiment of the invention, the loading system 20 has been indicated as including two hoppers 21 and 25, it will be appreciated that any number of such hoppers could be utilized, and that any number of input conveyors may feed each such hopper. In a constructional model of the present invention, the length of the mixing apparatus 40 is about 15–20 feet, each of the plow blades 65 has a diameter of approximately five or six inches and is spaced from the support reach 13 by about one inch.

From the foregoing, it can be seen that there has been provided an improved mixing apparatus and conveyor system incorporating same, wherein the mixing apparatus can be readily retrofitted to an existing conveyor without modification thereof, and provides a simple and economical means for mixing crushed or pulverulent material conveyed past the mixing apparatus.

I claim:

1. Mixing apparatus for mixing pulverulent or other bulk material while is it conveyed in a continuous stream on a belt conveyor, wherein the stream is made up of a plurality of substreams of different compositions, said mixing apparatus comprising: plow means supported adjacent to and extending into the stream of material on the conveyor belt, said plow means including a plurality of fixed curved blades spaced apart both laterally and longitudinally of the conveyor belt, means immovably mounting each of said blades with respect to the conveyor belt in a mixing position arranged to engage the stream on both sides of said blade and lift and displace a portion of the stream both transversely and laterally relative to the conveyor belt for commingling adjacent substreams, at least certain ones of said blades being disposed for displacing the engaged portions of the stream laterally toward the center of the conveyor belt, thereby to mix together the compositions of the substreams.

2. The mixing apparatus of claim 1, wherein the number of said blades is at least four.

3. The mixing apparatus of claim 2, wherein the number of said blades is twelve.

4. The mixing apparatus of claim 1, wherein at least certain ones of said blades are arranged to displace the engaged portions of the stream laterally outwardly toward the side edges of the conveyor belt.

5. The mixing apparatus of claim 4, and further including side plates respectively disposed along the opposite side edges of the conveyor belt adjacent to said plow means for preventing spillage of material from the conveyor belt.

6. The mixing apparatus of claim 1, wherein said plow means includes adjustment means for effecting both horizontal and vertical adjustment of the positions of said blades for varying the locations of said blades with respect to the conveyor belt and for varying the depth of insertion of said blades into the stream of material.

7. Mixing apparatus for mixing pulverulent or other bulk material while it is conveyed in a continuous stream on a belt conveyor, wherein the stream is made up of a plurality of substreams of different compositions, said mixing apparatus comprising: a frame mounted adjacent to and extending across the conveyor, a plurality of plow assemblies each including an elongated support rod and a curved plow blade fixed to said rod at one end thereof, means fixedly mounting said plow assemblies on said frame with said rods depending from said frame over the conveyor belt and with said plow blades immovable with respect to the conveyor belt and extending into the stream of material respectively at spaced-apart locations, said mounting means including adjustment means accommodating vertical and horizontal adjustment of the positions of said plow assemblies for varying the locations of the plow assemblies with respect to the conveyor belt and for varying the depth of insertion of the plow blades into the stream of material, each of said plow blades being disposed to engage a portion of the stream and displace that portion both vertically and laterally of the the conveyor belt for commingling adjacent substreams thereby to mix together the compositions of the substreams.

8. The mixing apparatus of claim 7, wherein each of said rods is integral with its associated plow blade.

9. The mixing apparatus of claim 7, wherein each of said rods is threaded at the upper end thereof, said mounting means including means threadedly engaged with said rods for accommodating axial movement thereof to adjust the depths of insertion of said plow blades in the stream of material.

10. The mixing apparatus of claim 7, wherein said frame includes support members overlying the conveyor belt, said support members having elongated slots therein for respectively receiving the upper ends of said rods and accommodating limited horizontal movement of said rods within said slots, said mounting means including means for fixedly positioning each of said rods with respect to its associated slot.

11. The mixing apparatus of claim 10, wherein at least certain ones of said slots are generally T-shaped.

12. The mixing apparatus of claim 7, wherein said frame includes a longitudinal beam and a plurality of longitudinally spaced-apart cross beams intersecting said longitudinal beam above said conveyor belt, said mounting means effecting mounting of certain ones of said rods on said longitudinal beam and others of said rods on said cross beams at positions spaced laterally from said longitudinal beam on either side thereof.

13. A conveyor system for pulverulent or other bulk material comprising: a belt conveyor for conveying the material in a continuous stream, loading means disposed adjacent to an input end of said conveyor for depositing thereon a plurality of substreams of different compositions of material which cooperate to make up said continuous stream, a frame disposed adjacent to said conveyor downstream from said loading means, plow means carried by said frame and extending into said stream of material on said conveyor belt, said plow means including a plurality of fixed curved blades spaced apart both laterally and longitudinally of the conveyor belt, means immovably mounting each of said blades with respect to the conveyor belt in a mixing position arranged to engage said stream on both sides of said blade and displace a portion of the stream both transversely and laterally of said conveyor belt for commingling adjacent ones of said substreams, at least certain ones of said blades being disposed for displacing the engaged portions of the stream laterally toward the center of the conveyor belt, thereby to mix together the compositions of said substreams.

14. The system of claim 13, wherein at least certain ones of said substreams comprise vertically contiguous layers on the conveyor belt.

15. The system of claim 13, wherein said loading means includes a hopper overlying said conveyor belt for depositing material thereon.

16. The system of claim 15, wherein said loading means further includes means for feeding two different compositions of material into said hopper.

17. The system of claim 15, wherein said loading means includes plural hoppers overlying said conveyor belt and spaced apart longitudinally thereof for respectively depositing thereon substreams of material.

18. The system of claim 17, wherein said loading means further includes means for feeding two different compositions of material into each of said hoppers.

* * * * *